US006206076B1

(12) United States Patent
Stawski

(10) Patent No.: US 6,206,076 B1
(45) Date of Patent: Mar. 27, 2001

(54) SKYLIGHT SHADE

(75) Inventor: Karl-Heinz Stawski, Cologne (DE)

(73) Assignee: Weinor Dieter Weiermann GmbH & Co., Cologne (DE)

( * ) Notice: Subject to any disclaimer, the term of this patent is extended or adjusted under 35 U.S.C. 154(b) by 0 days.

(21) Appl. No.: 09/420,110

(22) Filed: Oct. 18, 1999

(30) Foreign Application Priority Data

Oct. 16, 1998 (DE) ..... 198 47 728
Aug. 24, 1999 (DE) ..... 199 40 106

(51) Int. Cl.[7] ..... A47H 1/00

(52) U.S. Cl. ..... 160/98; 160/265; 160/310; 52/200

(58) Field of Search ..... 160/31, 23.1, 98, 160/99, 100, 238, 239, 265, 266, 272, 284, 310, 311, 312, 313, 320; 52/72, 200

(56) References Cited

U.S. PATENT DOCUMENTS 3,180,401 * 4/1965 Gambon et al. ..... 160/265
3,460,602 * 8/1969 Hugus ..... 160/265
4,610,116 * 9/1986 Schulz ..... 52/204
4,703,596 * 11/1987 Sandow ..... 52/200
4,762,160 * 8/1988 Bechtold et al. ..... 160/98
4,860,511 * 8/1989 Weisner et al. ..... 52/200
4,930,274 * 6/1990 Cummings et al. ..... 52/200
5,088,543 * 2/1992 Bibrey ..... 160/310
5,094,040 * 3/1992 Bunka ..... 52/200 X
5,159,967 * 11/1992 Ashley et al. ..... 160/265
5,300,867 * 4/1994 Brade et al. ..... 160/310 X
5,323,831 * 6/1994 Manthei ..... 160/23.1
5,372,173 * 12/1994 Horner ..... 160/98
5,479,979 * 1/1996 Hayashiguchi ..... 160/265
5,555,683 * 9/1996 Schroeder ..... 52/200
5,617,682 * 4/1997 Christopher ..... 52/200
5,752,557 * 5/1998 Crider et al. ..... 160/265 X
5,765,324 * 6/1998 Schulz ..... 52/200

FOREIGN PATENT DOCUMENTS 40 31 471 4/1992 (DE) .
34 08 379 9/1994 (DE) .

* cited by examiner

*Primary Examiner*—Bruce A. Lev
(74) *Attorney, Agent, or Firm*—Herbert Dubno; Andrew Wilford

(57) ABSTRACT

A roof window having an upper edge and a lower edge is provided with a shade assembly that has a flexible shade having a pair of opposite ends, a rotatable shaft attached to one of the shade ends, and a mount rotatably supporting the shaft at the lower window edge. A motor and spring unit attached to the shaft and to the other of the shade ends can wind the shade around the shaft in an open position of the assembly and unwind the shade from the shaft and pull it up along the window until the other shade end is at the upper edge in a closed position of the assembly. A pair of guides extend generally parallel to each other between the window edges. The one shade end is displaceable along the guides and respective cables attached to the one shade end extend along the guides. The shade assembly further has a stiff bar extending along the one shade edge and rollers on ends of the bar riding in the guides and attached to the cables. The guides are stiff aluminum profile rails forming horizontally open confronting guide grooves in which the respective rollers ride. In addition the roof window has a glass pane with side edges fixed in the profile rails below the respective grooves.

15 Claims, 6 Drawing Sheets

FIG.4
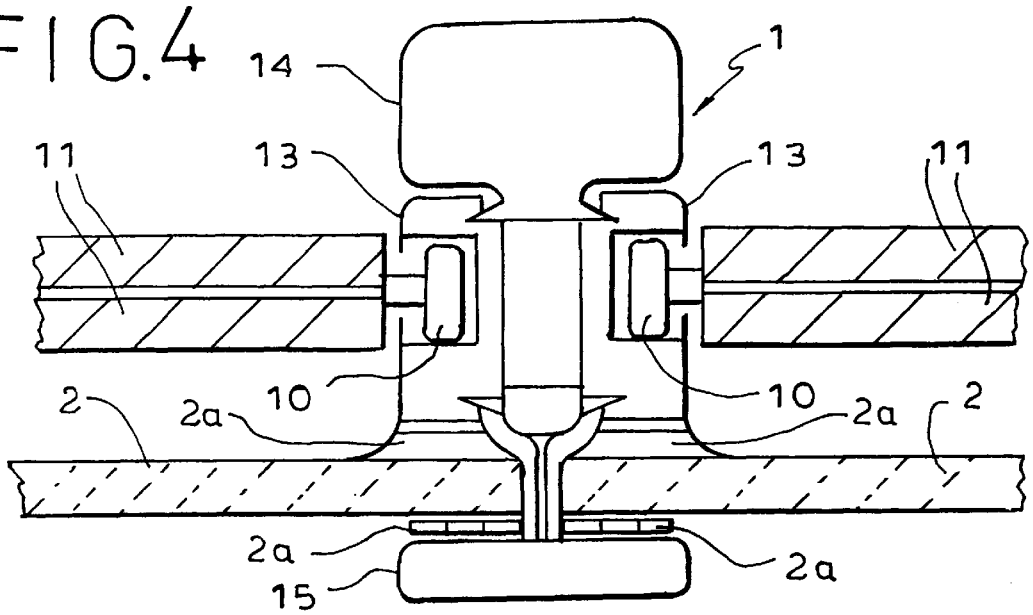
FIG.5
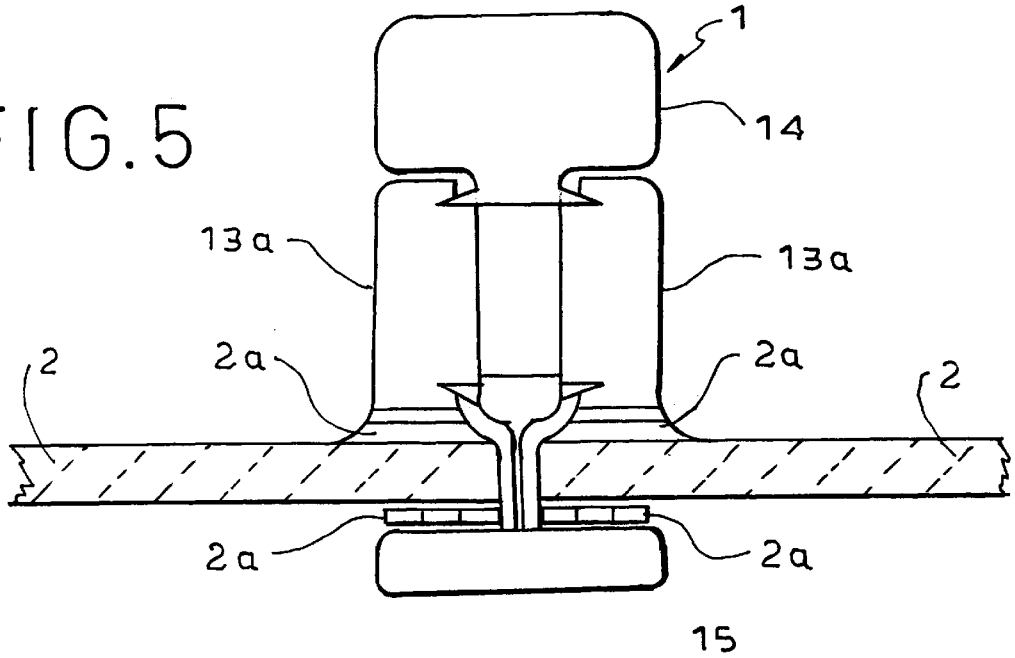
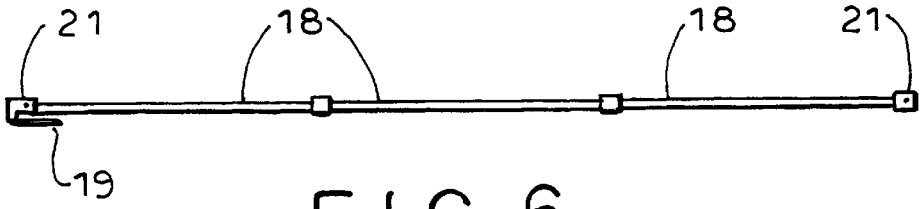
FIG.6

SKYLIGHT SHADE

FIELD OF THE INVENTION

The present invention relates to a shade. More particularly this invention concerns such a shade used on a glass roof window, that is on a window or skylight installed in a roof at a small acute angle to the horizontal.

BACKGROUND OF THE INVENTION

A skylight or glass roof such as is used in a greenhouse is typically provided with a shade that can be drawn to keep out light when desired. Such shades can be mounted externally or internally, the former normally being preferred when inside space is at a premium.

The standard external-mount shade assembly comprises a rod mounted at the upper edge of the window and around which the shade is wound. Mechanism extending down from the leading edge of the shade can draw it down to the lower eave edge.

Thus with this system the assembly always blocks at least part of the roof window. Thus some of the benefit of the window is lost. In addition the shade assembly creates an unattractive encumbrance on the roof plane and can catch debris and snow.

OBJECTS OF THE INVENTION

It is therefore an object of the present invention to provide an improved roof-window or skylight shade.

Another object is the provision of such an improved roof-window or skylight shade which overcomes the above-given disadvantages, that is which does not, when rolled up, block the window and which is an unobtrusive structure.

SUMMARY OF THE INVENTION

A roof window having an upper edge and a lower edge is provided with a shade assembly that has according to the invention a flexible shade having a pair of opposite ends, a rotatable shaft attached to one of the shade ends, and a mount rotatably supporting the shaft at the lower window edge. A motor and spring unit attached to the shaft and to the other of the shade ends can wind the shade around the shaft in an open position of the assembly and unwind the shade from the shaft and pull it up along the window until the other shade end is at the upper edge in a closed position of the assembly.

Thus with this system the shaft and motor can all be put completely out of the way. In accordance with the invention a rain gutter is fixed at the lower window edge and the mount and shaft are in the gutter. The shade is completely out sight when not closed.

The means for moving the shade includes a pair of guides extending generally parallel to each other between the window edges. The one shade end is displaceable along the guides and respective cables attached to the one shade end extend along the guides.

The shade assembly further has according to the invention a stiff bar extending along the one shade edge and rollers on ends of the bar riding in the guide rails and attached to the cables. The guides are stiff aluminum profile rails forming horizontally open confronting guide grooves in which the respective rollers ride. In addition the roof window has a glass pane with side edges fixed in the profile rails below the respective grooves.

A biasing or spring unit is attached to the cables for maintaining same under tension. Two such spring units are each braced between a respective one of the guide rails and a respective end of the bar. Each spring unit includes a respective fixed end member in the respective rail at the upper end thereof and carrying at least one wheel over which the respective cable passes, a respective movable end member longitudinally displaceable in the respective rail and carrying at least one wheel over which the respective cable passes, and a respective longitudinally extensible spring element in the respective rail braced against the respective movable end member and urging same away from the respective fixed end member. Thus these spring units, which provide the motive force that actually closes the shade, are completely concealed in the rails.

The shaft is connected to a motor that rotates it. In addition the rails each-have a lower fixed part and an upper retaining part removably clipped to the fixed part and pressing a respective edge of the window against the fixed part and holding the spring unit. It is also possible for the spring unit to be mounted on the bar or for a plurality of such shade assemblies to be arranged one next to the other and interconnected by a horizontal beam extending along all of the assemblies. In this latter case the spring unit is connected to the beam and is mounted above an upper edge of the window.

Furthermore for big installations steel reinforcements extend longitudinally in the guide rails.

BRIEF DESCRIPTION OF THE DRAWING

The above and other objects, features, and advantages will become more readily apparent from the following description, reference being made to the accompanying drawing in which:

FIGS. 4 and 5 are views like respective FIGS. 2 and 3 of a variant on the system of FIGS. 1 to 3;

FIG. 6 is a small-scale view of the pneumatic spring unit of the invention;

SPECIFIC DESCRIPTION

Figure 1:
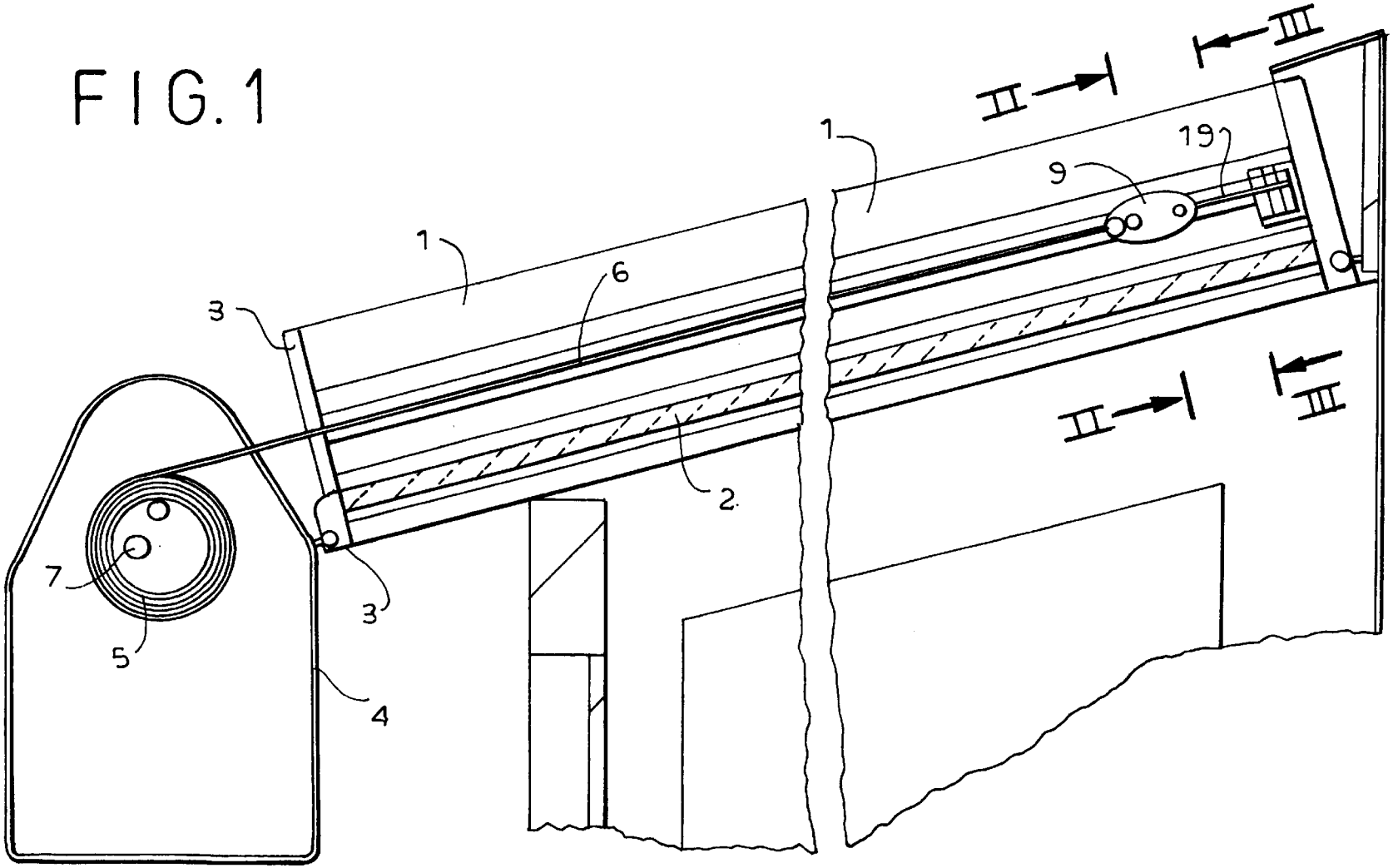
FIG. 1 is a partly sectional side view of the shade assembly according to the invention.
Figure 2:
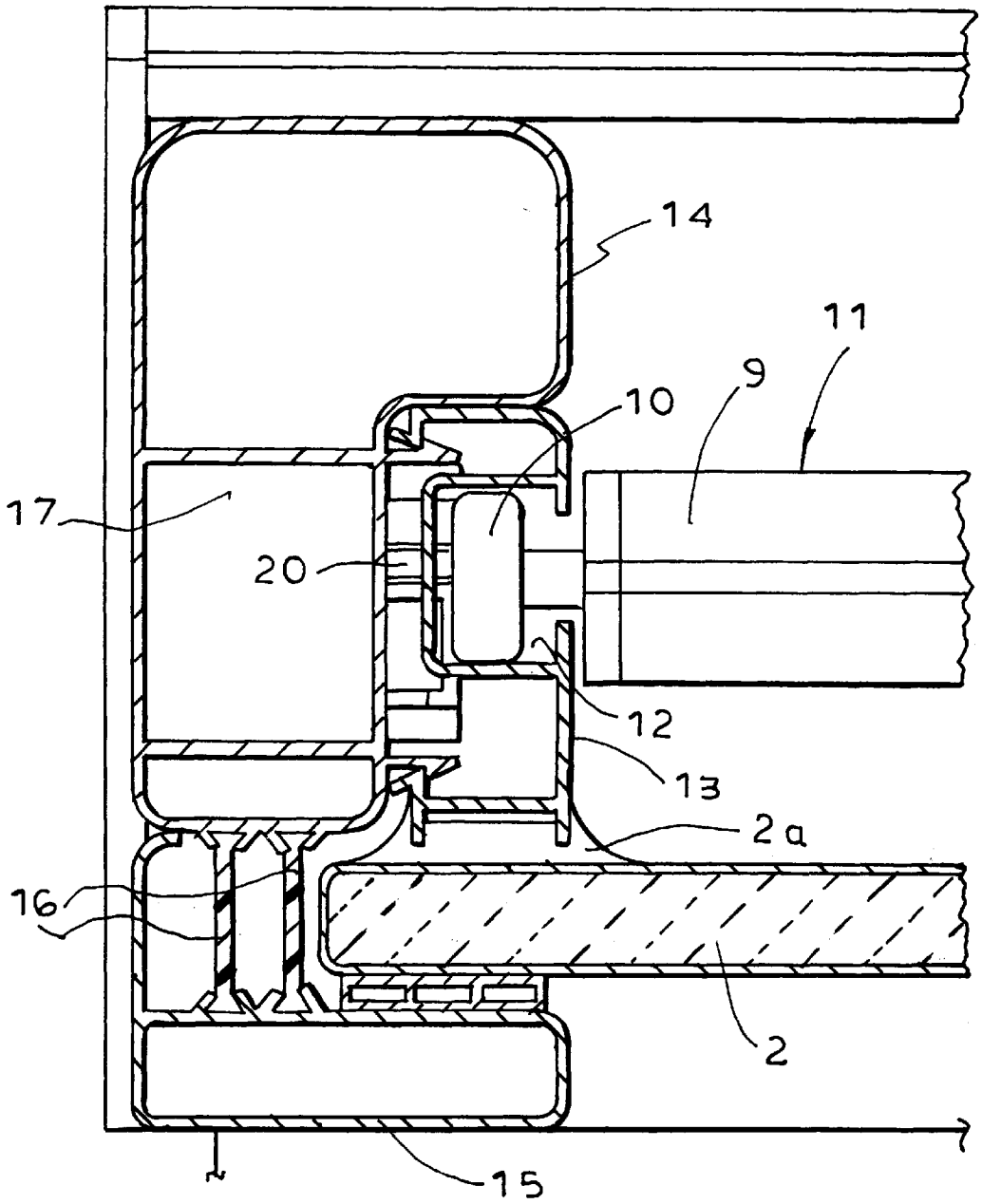
FIGS. 2 and 3 are large-scale cross sections taken along respective lines II—II and III—III of FIG. 1.

As seen in FIGS. 1 and 2 a shade assembly according to the invention has a pair of side profiled guide rails 1 formed of aluminum and carrying a glass pane 2. Lower ends of the rails 1 are interconnected by an eave beam 3 from which is suspended an upwardly open channel-shaped gutter 4 intended to catch water running off the window pane 2. Seals 2*a* prevent leakage between the pane 2 and the guide rail 1.

A rod or shaft 5 powered by a schematically illustrated electric motor 7 is provided in the gutter 4 so as to be completely concealed by it. A shade 6 has a lower edge attached to the shaft 5 and an upper edge fixed in a bar 9 whose ends carry rollers 10 that form with the bar 9 a carriage 11 guided in grooves or tracks 12 in the rails 1. To this end the rails 1 are formed of main portions 14 to which are clipped portions 13 forming the grooves 12. Further portions 15 are secured by thermal breaks 16 to the main part 14 which forms a passage 17.

Figure 3:
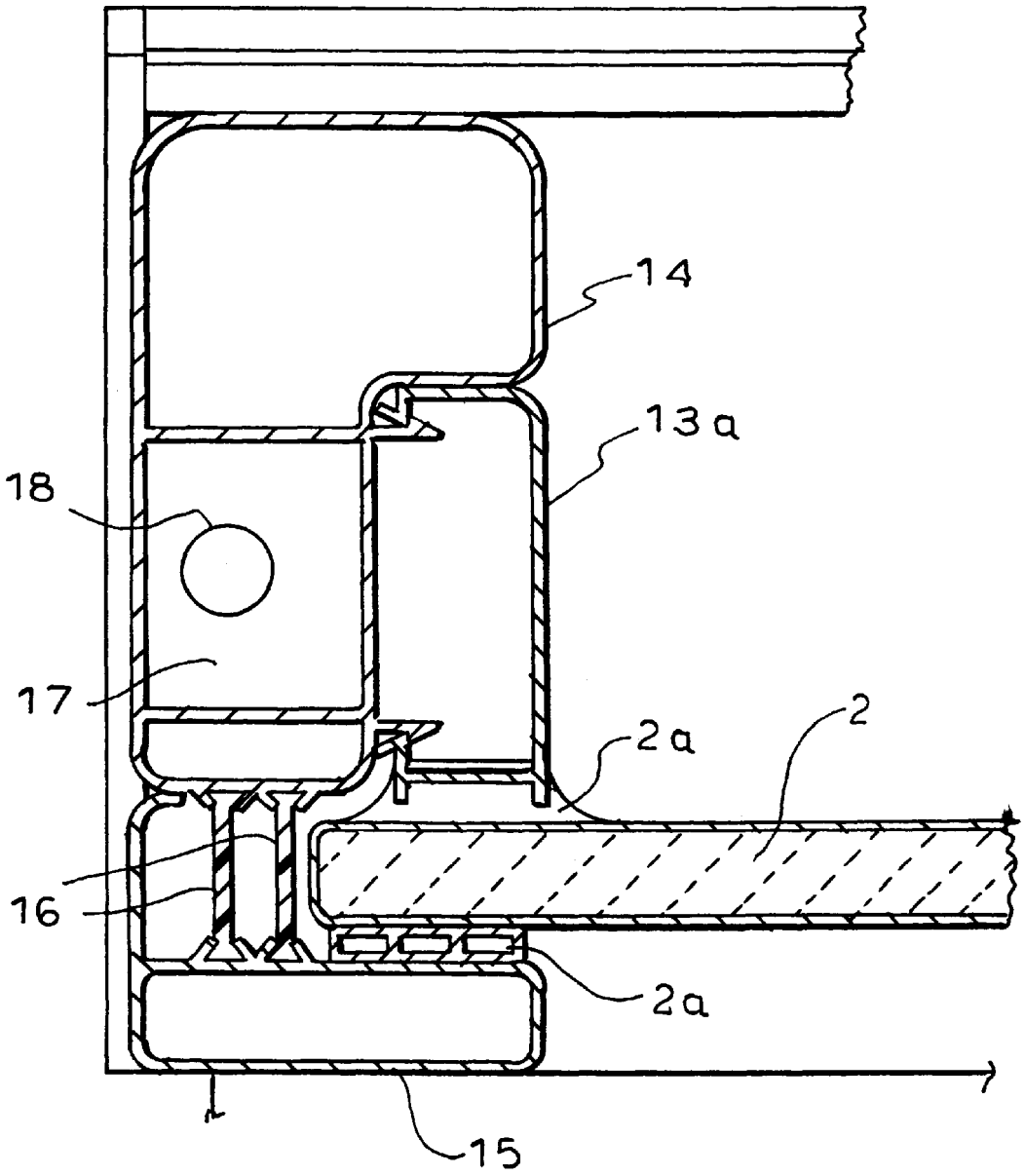

The edge of the pane 2 with its seals 2*a* is retained between the portions 13 and 15, so the portions 13 can be removed for replacement of this pane 2 if needed. FIG. 3 illustrates how in a system not needing a shade 6 the rail portion 13 can be replaced by a blank rail portion 13*a*.

Figure 7:
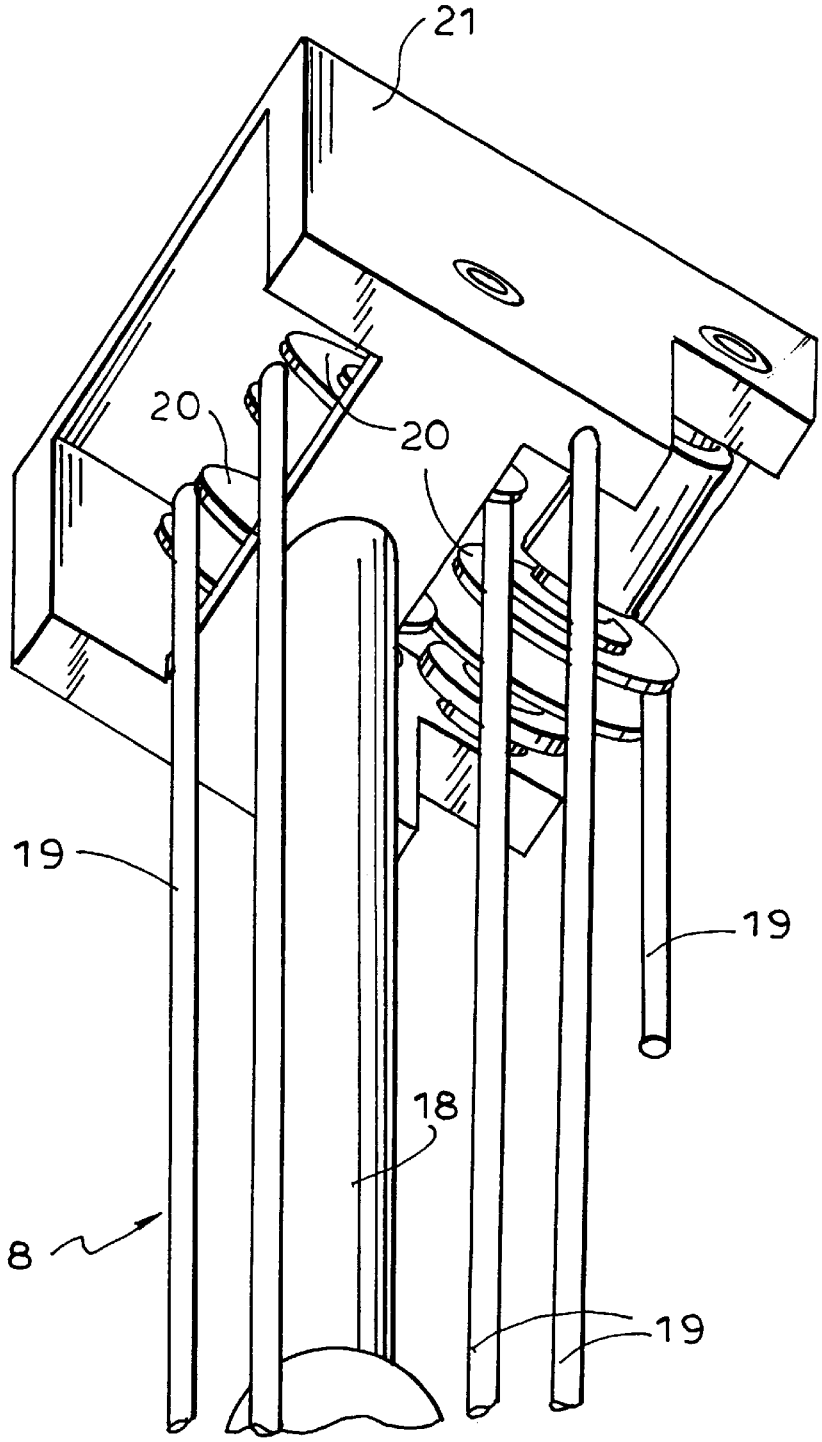
FIG. 7 is a perspective view of a detail of the invention.

Inside this chamber or passage 17 is a biasing unit 8 comprising as shown in FIG. 6 a plurality of longitudinally aligned pneumatic springs 18 braced between a pair of end members 21 carrying rollers 20 over which a cable 19 is spanned. One of the end members 21 is fixed at an upper end of the respective rail 1 and the other end member 21 can move longitudinally in the passage 17 therebelow. One end of the cable 19 is fixed to one of the end members 21 as shown in FIG. 7 and the other end to a respective outer end of the bar 9. Each cable 19 passes back and forth between several sets of wheels 20 so that the longitudinal stroke of the movable end member 21 is a fraction of the longitudinal stroke of the bar 9, like a multiple-sheave pulley. The spring unit 8 exerts enough tension on the shade 6 that when the shade 6 is to be closed by being pulled up along the pane 2, the motor 7 need merely pay it out, while for opening the shade 6, that is pulling it down, the motor 7 is merely working against the spring force.

In the arrangement of FIGS. 4 and 5 parts with the same reference numerals used in FIGS. 1 to 3 are functionally identical but shaped somewhat differently. This arrangement operates the same as the system of FIGS. 1 to 3.

Figure 8:
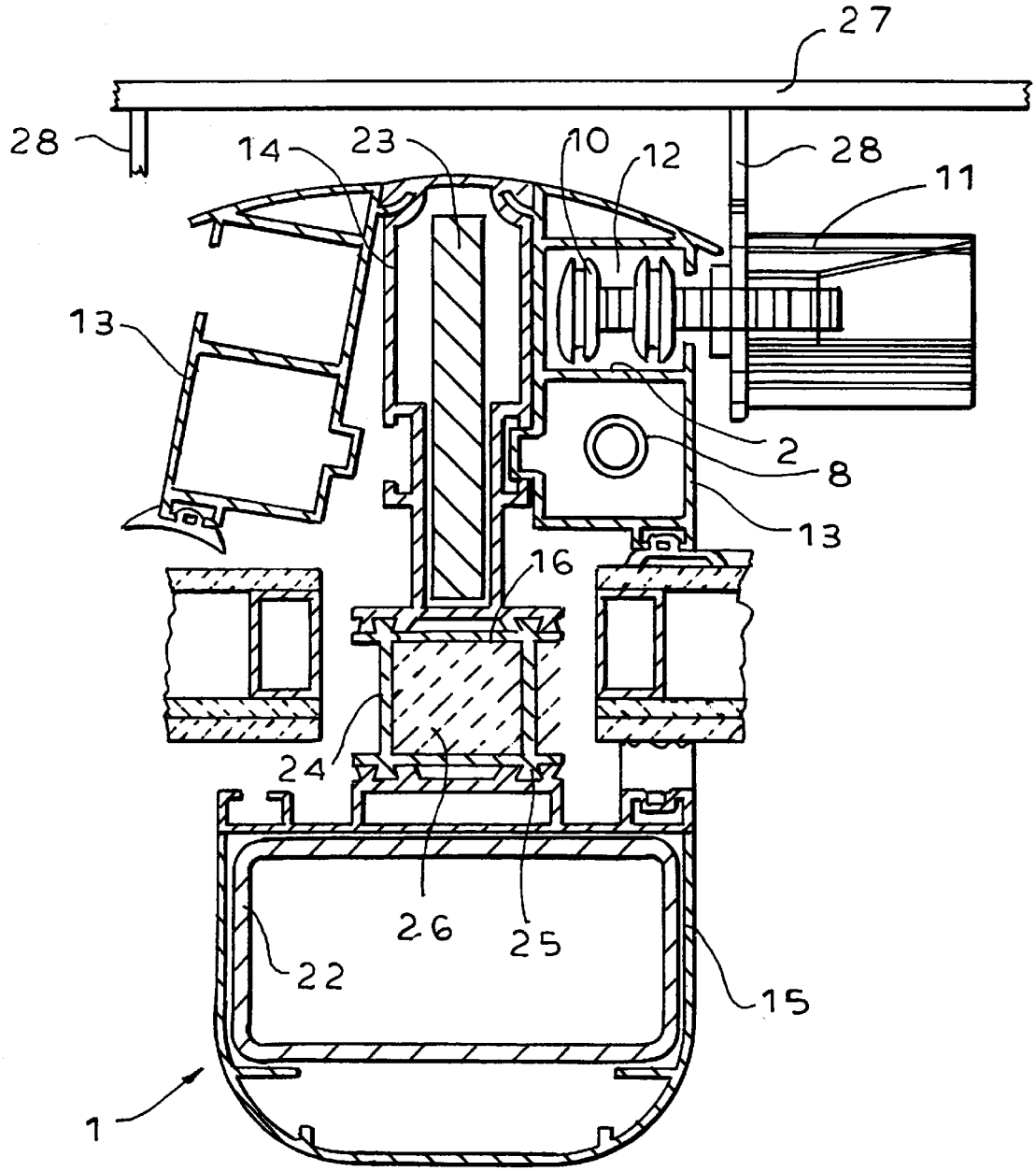
FIG. 8 is a view like FIG. 2 or 4 of another system in accordance with the invention.

In FIG. 8 the rail portions 13, 14, and 15 are mounted on a hollow main steel support beam 22 of square section and around another solid steel stiffening bar 23. The thermal break 16 here is formed by rigid-plastic webs 24 surrounding a closed-pore foam-plastic body 26 and having dovetail ridges 25 received in the rails 14 and 15. Here the spring unit 8 is received in the rail portion 13 forming an LS groove 12. The portions 13 pivot into place as shown on the left for easy assembly and disassembly of the system. FIG. 8 also schematically illustrates a main bar 27 with struts 28 connected to the ends of the bars 11 so that this main bar 27, on which the spring unit 8 mounted at the roof ridge can act directly, serves to open and close a plurality of the shades 6 at one time.

I claim:

1. In combination with a roof window having an upper edge and a lower edge, a shade assembly comprising:

a flexible shade having a pair of opposite ends;

a rotatable shaft attached to one of the shade ends;

a mount rotatably supporting the shaft at the lower window edge;

winding means attached to the shaft and to the other of the shade ends for winding the shade around the shaft in an open position of the assembly and for unwinding the shade from the shaft and pulling it up along the window until the other shade end is at the upper edge in a closed position of the assembly; and a U-shaped channel forming a rain gutter fixed at the lower window edge, the mount and shaft being completely concealed in the gutter.

2. The shade assembly defined in claim 1 wherein the winding means include a pair of guides extending generally parallel to each other between the window edges, the one shade end being displaceable along the guides; and respective cables attached to the one shade end and extending along the guides.

3. The shade assembly defined in claim 1, further comprising:

a stiff bar extending along the one shade end; and rollers on ends of the bar riding in the guides and attached to the cables.

4. The shade assembly defined in claim 3 wherein the guides are stiff profile rails forming horizontally open confronting guide grooves in which the respective rollers ride.

5. The shade assembly defined in claim 4 wherein the roof window has a glass pane with side edges fixed in the profile rails below the respective grooves.

6. The shade assembly defined in claim 3, further comprising spring means attached to the cables for maintaining same under tension.

7. The shade assembly defined in claim 6 wherein two such spring means are each braced between a respective one of the guide rails and a respective end of the bar.

8. The shade assembly defined in claim 6 wherein the winding means includes a motor connected to the shaft for rotating same.

9. The shade assembly defined in claim 6 wherein the rails each have a lower fixed part and an upper retaining part pressing a respective edge of the window against the fixed part and holding the spring means.

10. The shade assembly defined in claim 3, further comprising steel reinforcements extending longitudinally in the guide rails.

11. In combination with a roof window having an upper edge and a lower edge, a shade assembly comprising:

a flexible shade having a Pair of opposite ends;

a rotatable shaft attached to one of the shade ends;

a mount rotatable supporting the shaft at the lower window edge;

winding means attached to the shaft and to the other of the shade ends for winding the shade around the shaft in an open position of the assembly and for unwinding the shade from the shaft and pulling it up along the window until the other shade end is at the upper edge in a closed position of the assembly;

a U-shaped channel forming a rain gutter fixed at the lower window edge, the mount and shaft being completely concealed in the gutter;

a stiff bar extending along the one shade end;

rollers on ends of the bar riding in the guides and attached to the cables;

spring means attached to the cables for maintaining same under tension;

said spring means including:

a respective fixed end member in each rail at the upper end and carrying at least one wheel over which the respective cable passes, a respective movable end member longitudinally displaceable in each rail and carrying at least one wheel over which the respective cable passes, and a respective longitudinally extensible spring element in each rail braced against the respective movable end member and urging same away from the respective fixed end member.

12. In combination with a roof window having an upper edge and a lower edge, a shade assembly comprising:

a flexible shade having a pair of opposite ends;

a rotatable shaft attached to one of the shade ends;

a mount rotatable supporting the shaft at the lower window edge;

winding means attached to the shaft and to the other of the shade ends for winding the shade around the shaft in an open position of the assembly and for unwinding the shade from the shaft and pulling it up along the window until the other shade end is at the upper edge in a closed position of the assembly;

a U-shaped channel forming a rain gutter fixed at the lower window edge, the mount and shaft being completely concealed in the gutter;

a stiff bar extending along the one shade end;

rollers on ends of the bar riding in the guides and attached to the cables;

spring means attached to the cables for maintaining same under tension, the spring means is mounted on the bar.

13. The shade assembly defined in claim 12 wherein a plurality of such shade assemblies are arranged one next to the other and further comprise a horizontal beam extending along all of the assemblies and connected to all of the bars.

14. The shade assembly defined in claim 13 wherein the spring means is connected to the beam.

15. The shade assembly defined in claim 12 wherein the spring means is mounted above an upper edge of the window.

* * * * *